US012276108B1

(12) United States Patent
Prince

(10) Patent No.: US 12,276,108 B1
(45) Date of Patent: Apr. 15, 2025

(54) STEP FLASHING AND MOISTURE BARRIER ASSEMBLY AND METHOD THEREFOR

(71) Applicant: Myrick Prince, Bullard, TX (US)

(72) Inventor: Myrick Prince, Bullard, TX (US)

( * ) Notice: Subject to any disclaimer, the term of this patent is extended or adjusted under 35 U.S.C. 154(b) by 0 days.

(21) Appl. No.: 18/819,306

(22) Filed: Aug. 29, 2024

(51) Int. Cl.
*E04D 13/14* (2006.01)

(52) U.S. Cl.
CPC ..... *E04D 13/14* (2013.01)

(58) Field of Classification Search
CPC ... E04D 13/14; E04D 13/147; E04D 13/1475; E04D 3/40; E04D 13/1478; E04D 13/1415
USPC ..... 52/58, 60, 62
See application file for complete search history.

(56) References Cited

U.S. PATENT DOCUMENTS 1,905,017 A 4/1933 Vallas
4,835,929 A * 6/1989 Bondoc ..... E04D 3/40 52/553
4,951,431 A * 8/1990 Sweers ..... E04D 13/1475 52/60
5,065,553 A 11/1991 Magid
5,170,597 A 12/1992 Stearns
5,619,827 A 4/1997 Church
D397,810 S 9/1998 Basset
6,754,993 B1 * 6/2004 Mayle ..... E04D 13/1407 52/287.1
8,206,817 B2 6/2012 Donovan
8,397,438 B2 3/2013 Hoy
9,097,020 B2 * 8/2015 Grubka ..... E04D 3/36
10,626,617 B2 * 4/2020 MeGee ..... E04D 13/15
2008/0307715 A1 12/2008 Pufahl
2009/0090068 A1 4/2009 O'rourke

FOREIGN PATENT DOCUMENTS

WO WO2008045124 4/2008

* cited by examiner

*Primary Examiner* — Beth A Stephan

(57) ABSTRACT

A step flashing and moisture barrier assembly includes a panel and a layer of moisture-proof material. The panel has a front surface and a back surface and includes a first panel portion and a second panel portion joined transversely at a corner extending across the panel. The layer of moisture-proof material has a front surface attached to the back surface of the panel and a back surface that includes an adhesive material to permit attachment of the step flashing and moisture barrier assembly to a roof structure at a juncture of two roof surfaces.

6 Claims, 8 Drawing Sheets

STEP FLASHING AND MOISTURE BARRIER ASSEMBLY AND METHOD THEREFOR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to roofing materials and more particularly pertains to a new step flashing and moisture barrier assembly for easily and quickly installing step flashing pieces and a layer of moisture-proof material, also known as ice and water barrier or leak barrier. As is well known in the field of roofing, layers of moisture-proof material are installed at junctures or corners where two roof surfaces meet, such as where a roof deck meets a side wall or a chimney, due to the greater risk of leakage of water and the build up of ice dams. Such moisture-proof material is usually made of water- and vapor-proof materials, such as polymers, bitumen, and rubberized asphalt. In addition, flashing, which is essentially pieces of metal panels that are bent or otherwise conformed to fit the juncture, is installed over the moisture-proof material. Unfortunately, such moisture-proof material is sold in three-foot wide rolls of varying lengths, when usually only a small strip of material about eight inches in width is needed. As a result, large amounts of the expensive material are wasted in the trimming process, or too much material is used by workers who do not want to take the time to cut the smaller pieces sufficient to cover the juncture. Sometimes, due to the expense and/or effort involved, or by simply forgetting, workers do not even install the important moisture-proof material and only install the step flashing, which, while protective, does not provide the very secure seal and protective effect provided by the moisture-proof material. The present invention provides a step flashing and moisture barrier assembly that combines pieces of step flashing with pre-cut layers of moisture-proof material that are self-adhesive. The step flashing and moisture barrier assembly is easy to install and guarantees that the workers install the moisture-proof material without wasting any moisture-proof material due to cutting or using too large of a piece.

(2) Description of Related Art Including Information Disclosed Under 37 CFR 1.97 and 1.98

The prior art relates to roofing materials, such as flashing, leak barriers, and ice and water barriers, which are all sized and installed separately. The prior art, as best understood, does not disclose a step flashing and moisture barrier assembly that includes a panel and a layer of moisture-proof material, wherein the layer of moisture-proof material is attached to the back surface of the panel, and the layer includes an adhesive material to permit attachment of the step flashing and moisture barrier assembly to a roof structure at a juncture of two roof surfaces.

BRIEF SUMMARY OF THE INVENTION

An embodiment of the disclosure meets the needs presented above in a step flashing and moisture barrier assembly generally comprising a panel and a layer of moisture-proof material. The panel has a front surface and a back surface and includes a first panel portion and a second panel portion joined transversely at a corner extending across the panel. The layer of moisture-proof material has a front surface attached to the back surface of the panel and a back surface that includes an adhesive material to permit attachment of the step flashing and moisture barrier assembly to a roof structure at a juncture of two roof surfaces.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
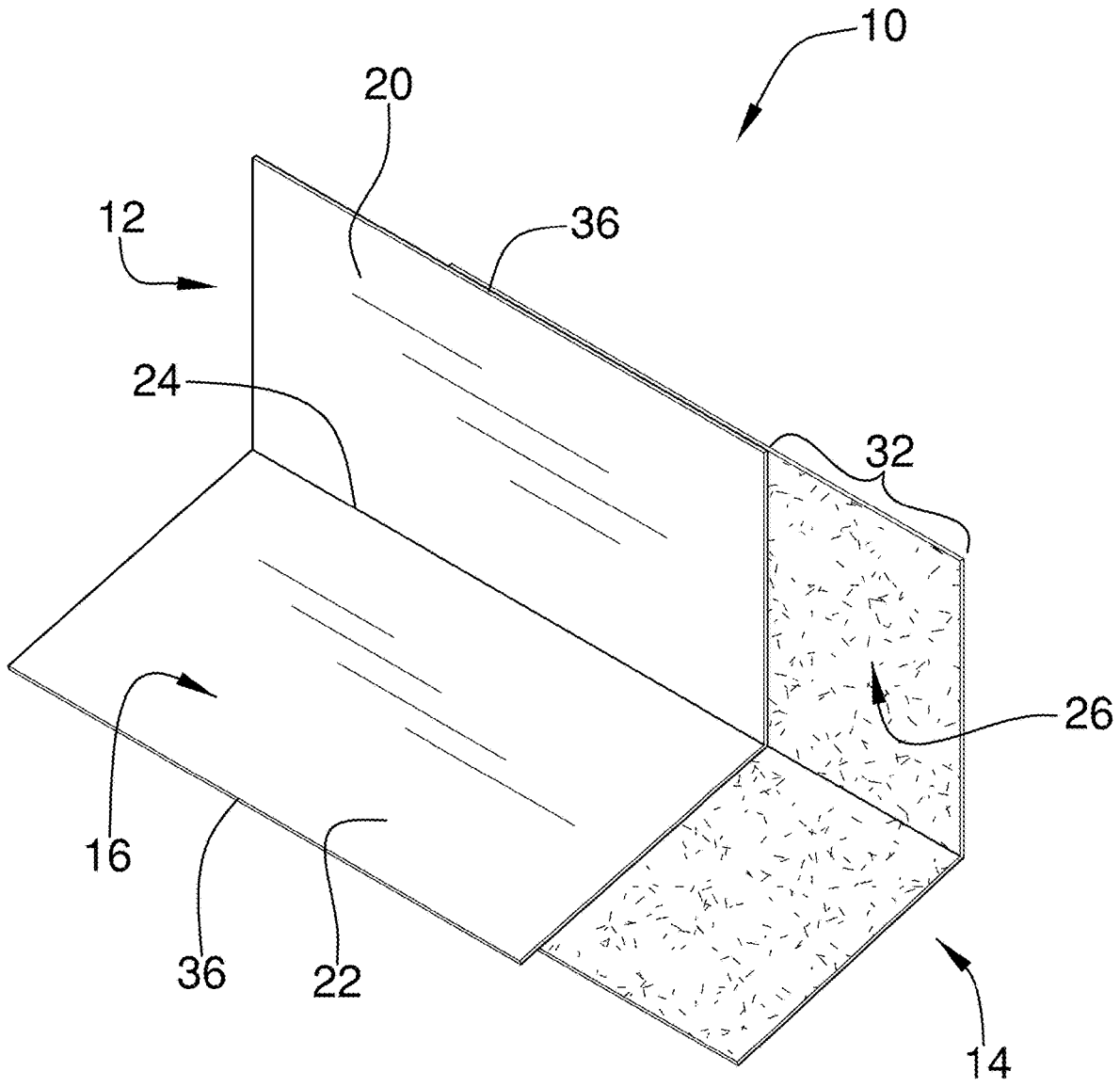
FIG. 1 is a front perspective view of a step flashing and moisture barrier assembly according to an embodiment of the disclosure.

With reference now to the drawings, and in particular to FIGS. 1 through 8 thereof, a new step flashing and moisture barrier assembly embodying the principles and concepts of an embodiment of the disclosure and generally designated by the reference numeral 10 will be described.

Figure 2:
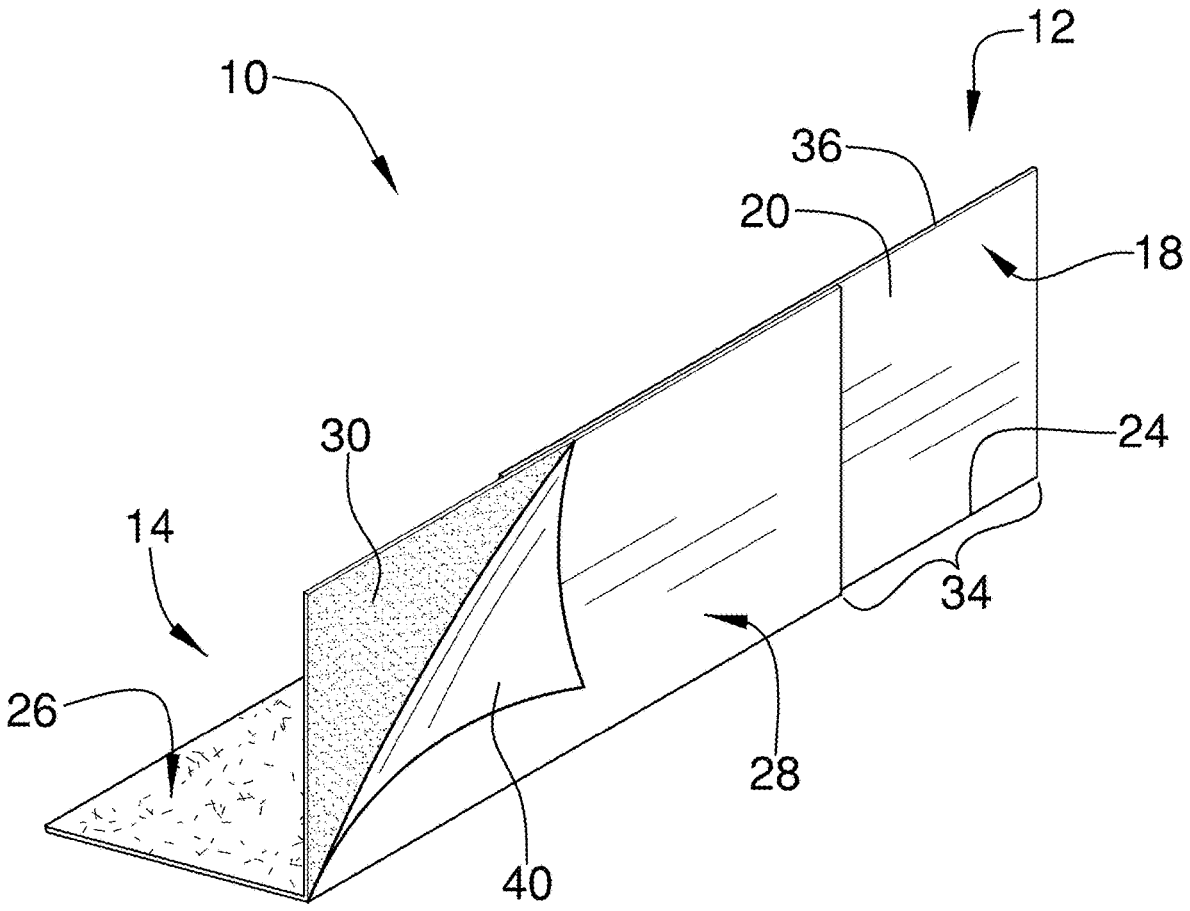
FIG. 2 is a rear perspective view of an embodiment of the disclosure.

As best illustrated in FIGS. 1 through 8, the step flashing and moisture barrier assembly 10 generally comprises A step flashing and moisture barrier assembly 10 includes a panel 12 and a layer 14 of moisture-proof material. As seen in FIGS. 1 and 2, the panel 12 has a front surface 16 and a back surface 18 and includes a first panel portion 20 and a second panel portion 22 joined transversely at a corner 24 extending across the panel 12. The layer 14 of moisture-proof material has a front surface 26 attached to the back surface 18 of the panel 12 and a back surface 28 that includes an adhesive material 30 to permit attachment of the step flashing and moisture barrier assembly 10 to a roof structure at a juncture of two roof surfaces.

The layer 14 and the panel 12 are offset with respect to one another in a direction parallel to the corner 24 such that the layer 14 partially overlaps the panel 12. As shown in FIG. 1, due to the offset, the layer 14 has an uncovered front surface section 32, and, as shown in FIG. 2, the panel 12 has an uncovered back surface section 34. While these could be any size, in the exemplary embodiment shown, the uncovered front surface section 32 of the layer 14 is about 2.0 to about 4.0 inches wide, and the uncovered back surface section 34 of the panel 12 is about 2.0 to about 4.0 inches wide. In one possible embodiment, each is about 3.0 inches wide.

Figure 3:
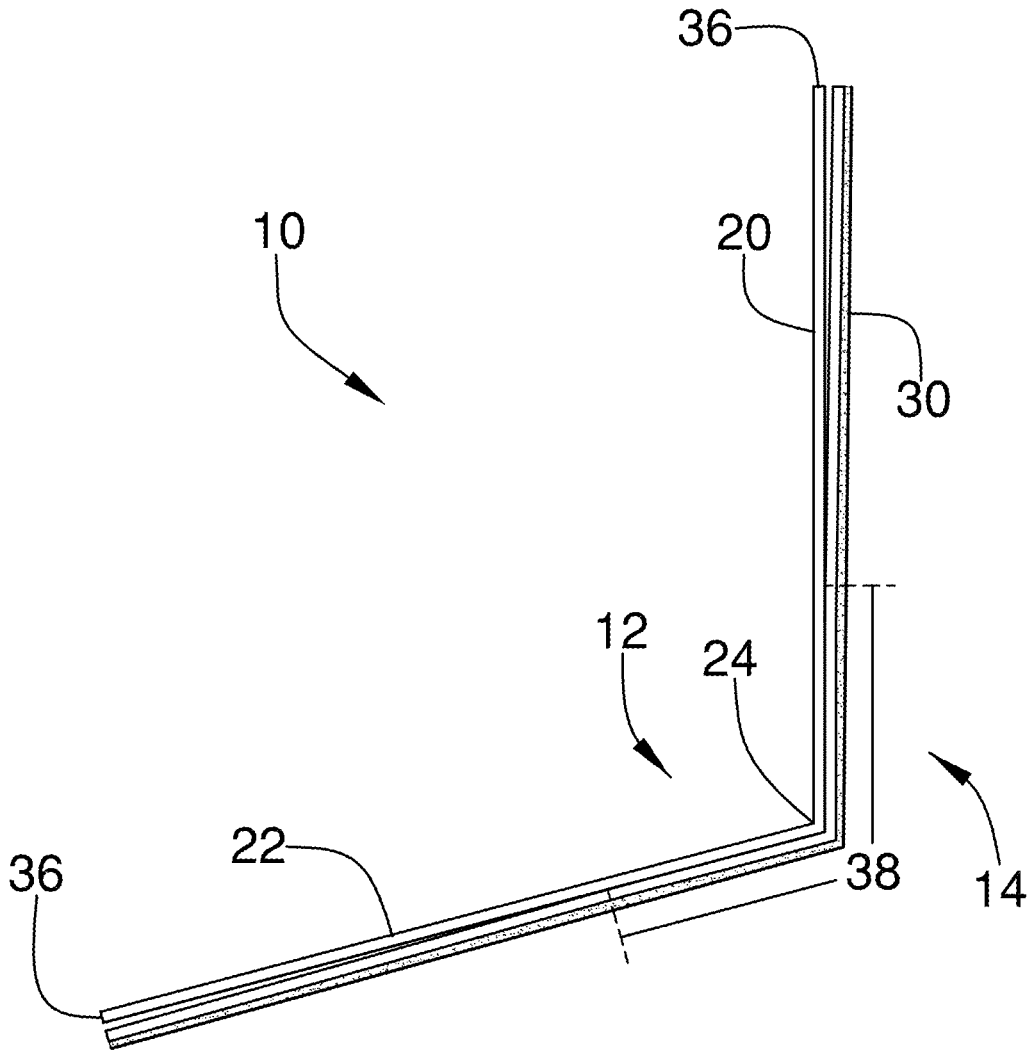
FIG. 3 is a side view of an embodiment of the disclosure.

As best seen in FIG. 3, the layer 14 is attached to the back surface 18 at the corner 24 and not attached at edges 36 of the panel 12. As will be discussed further below, this design permits insertion of a portion of underlayment and a portion of a shingle between the layer 14 and the panel 12. In the exemplary embodiment shown, the layer 14 is attached at an attachment section 38 of the back surface 18, which attachment section 38 runs along the length of the corner 24 and extends from the corner 24 about 1.0 inch on each of the first panel portion 20 and the second panel portion 22. In another possible embodiment, the attachment section 38 extends from the corner 24 about 2.0 inches. However, the extension of the attachment on either side of the corner 24 could be set as desired depending on the size of the layer 14 and the panel 12. In one possible embodiment, the attachment is only to one of the first panel portion 20 or the second panel portion 22, such that the space in between the layer 14 and the panel 12 extends all the way to the corner 24, such that an underlayment or shingle could be inserted to or almost to the corner 24. The attachment in this case could also extend all the way to the edge 36 of the panel 12. Such a design could be advantageous to completely seal the half of the step flashing and moisture barrier assembly 10 abutting a sidewall and allow for maximum overlap between the panel 12 and an underlayment or shingle at a roof deck.

The panel 12 itself is a piece of step flashing, which is made of metal. Such step flashing is essentially a bracket that is bent in half at a right angle such that there are two matching halves. However, as is well known in the roofing industry, the flashing can be bent at whatever angle is desired and in whatever proportions, such that the halves are similar in size or are different sizes, and the step flashing and moisture barrier assembly 10 can likewise be configured as desired. For example, in the exemplary embodiment shown in FIG. 3, the angle is not 90 degrees, though the panel 12 could easily be bent at a 90-degree angle, as is well known. In the exemplary embodiment, each of the first panel portion 20 and the second panel portion 22 is about 7.0 to 9.0 inches long at the corner 24 and about 3.5 to 4.5 inches wide, such that each of the first panel portion 20 and the second panel portion 22 is rectangular. As a result, the panel 12 as a whole could be rectangular or square. The layer 14 is about the same size as the panel 12 as shown in the drawings to promote the most efficient use of the material and minimize cost, though they could be different sizes and dimensions as desired.

As is well known, the layer 14 of moisture-proof material is flexible and includes at least one of: polymers, bitumen, and rubberized asphalt. As shown in FIG. 2, the layer 14 includes a peel-off cover 40 positioned on the adhesive material 30, which is removed to expose the adhesive material 30 prior to installation. The adhesive material 30 covers the entire back surface 28 of the layer 14 to ensure a full seal with the surfaces of a roof, though in another possible embodiment less adhesive material 30 could be used.

Figure 4:
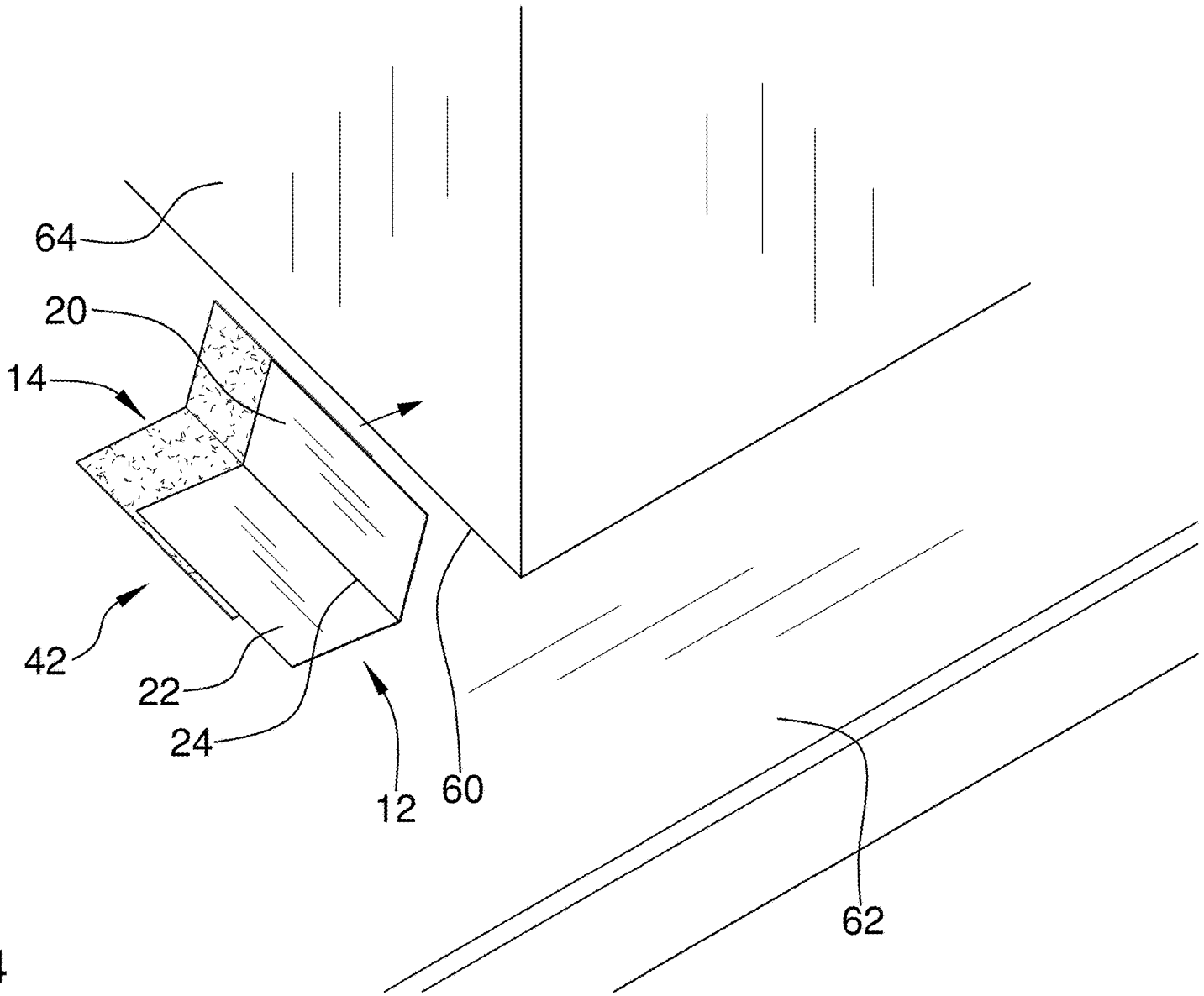
FIG. 4 is a perspective view of an embodiment of the disclosure in use.
Figure 5:
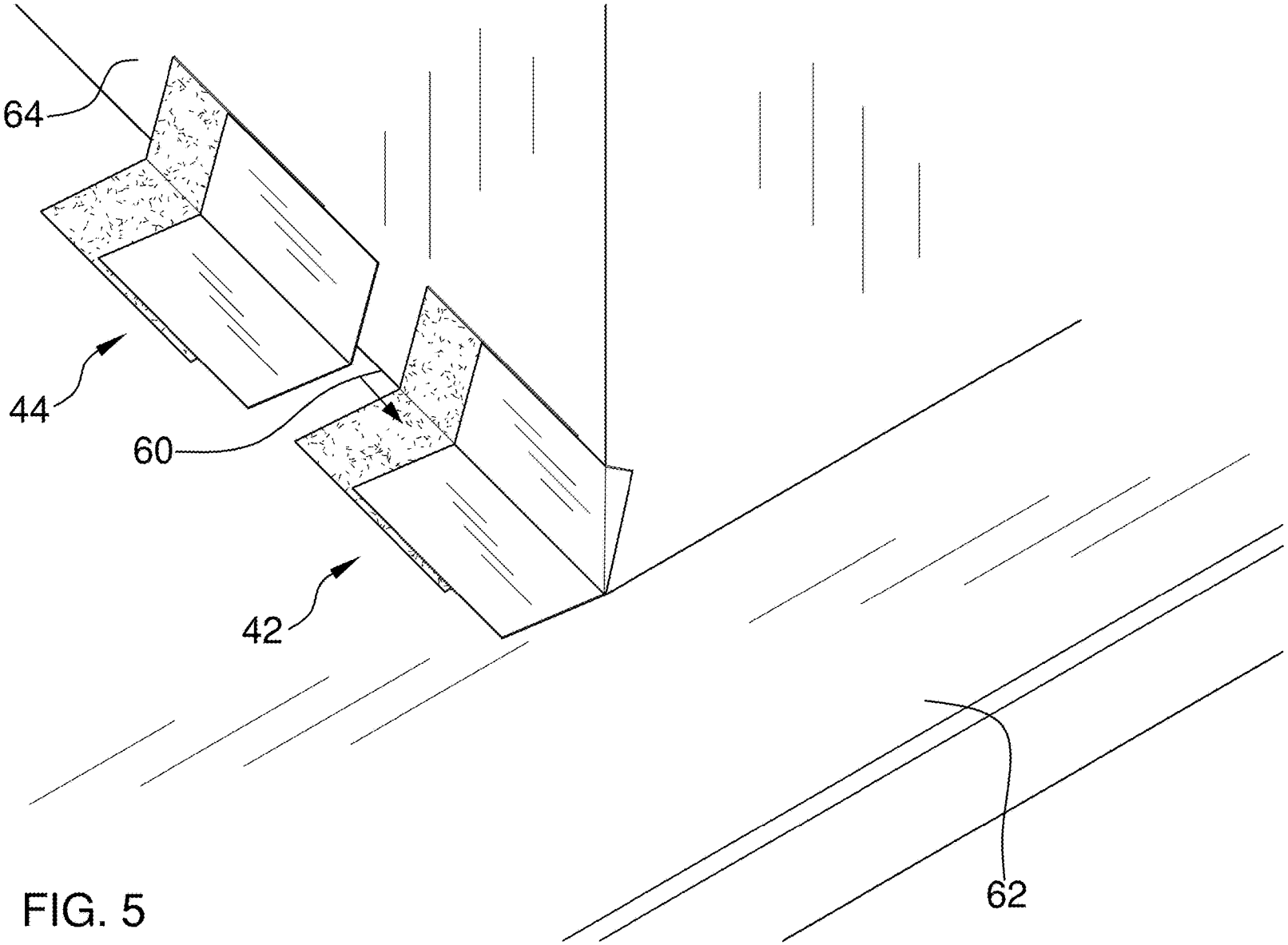
FIG. 5 is a perspective view of an embodiment of the disclosure in use.
Figure 6:
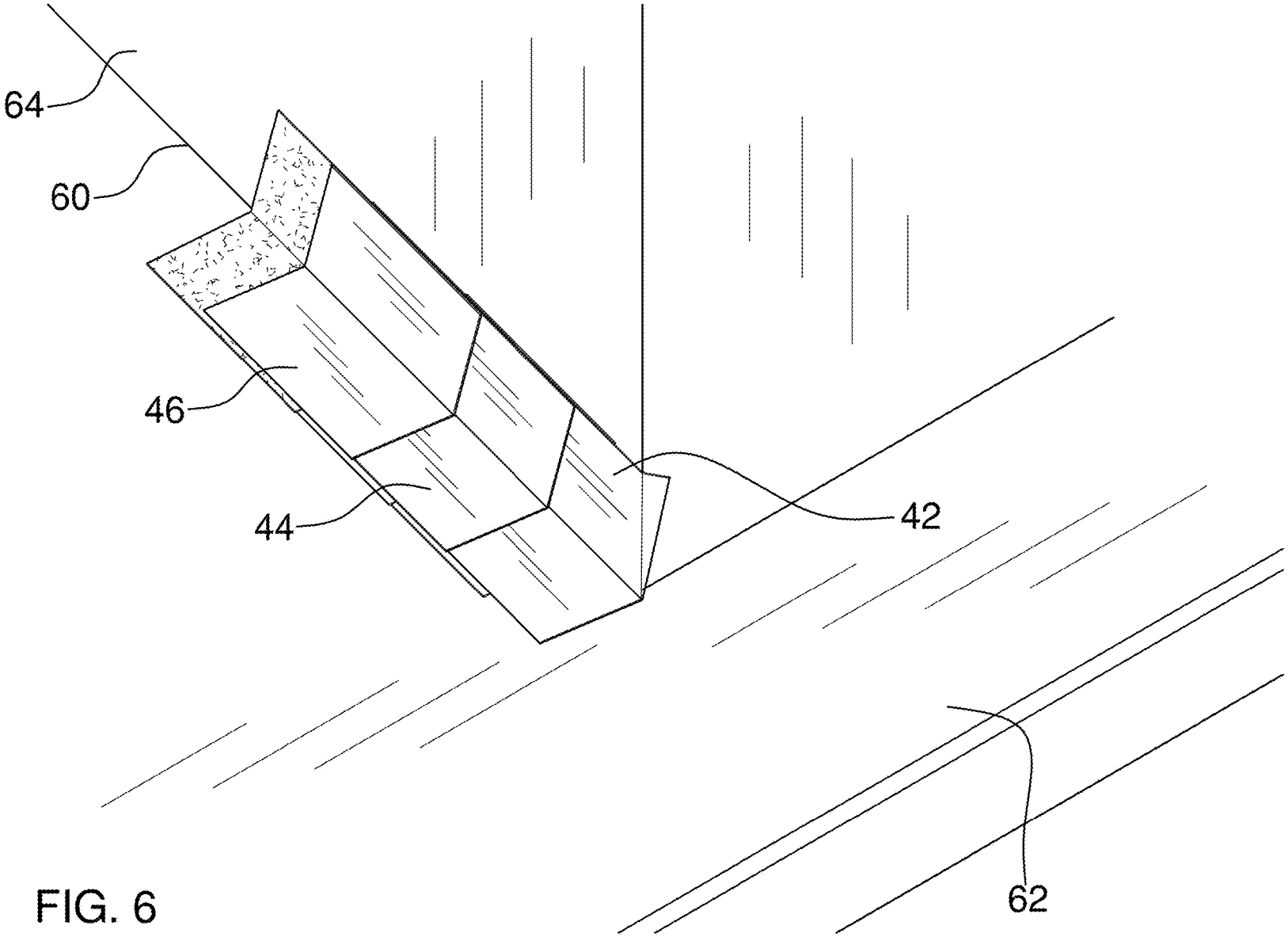
FIG. 6 is a perspective view of an embodiment of the disclosure in use.

FIGS. 4 through 7 show how to use the exemplary embodiment of the step flashing and moisture barrier assembly 10 to seal and cover a juncture 60 between two roof structures, in this case a roof deck 62 and a sidewall 64, though the step flashing and moisture barrier assembly 10 could be used at any juncture, such as a valley between two adjoining roof deck sections. As shown in FIG. 4, the layer 14 of a first step flashing and moisture barrier assembly 42 is pressed into the juncture 60 with the corner 24 aligned with the juncture 60. The adhesive material 30 on the back surface 28 of the layer 14 sticks to the roof deck 62 and the sidewall 64. FIG. 5 shows the placement of a second step flashing and moisture barrier assembly 44 in a stepped, partially overlapping manner on the first step flashing and moisture barrier assembly 42. The second step flashing and moisture barrier assembly 44 is slid laterally until the layer 14 of the second step flashing and moisture barrier assembly 44 abuts the panel 12 of the first step flashing and moisture barrier assembly 42, which essentially aligns each of the assemblies 42, 44 before the second step flashing and moisture barrier assembly 44 is pressed into place. At this point, the layer 14 of the second step flashing and moisture barrier assembly 44 overlaps and attaches to the uncovered front surface section 32 of the layer 14 of the first step flashing and moisture barrier assembly 42. In addition, the panel 12 of the second step flashing and moisture barrier assembly 44 partially overlaps the panel 12 of the first step flashing and moisture barrier assembly 42. This placement can be repeated with more assemblies, such as a third assembly 46 and a fourth assembly 48 shown in FIGS. 6 and 7, such that a continuous strip of moisture-proof material is formed by several overlapping layers 14 in a sealed arrangement, and a continuous strip of step flashing is formed by several overlapping panels 12.

Figure 7:
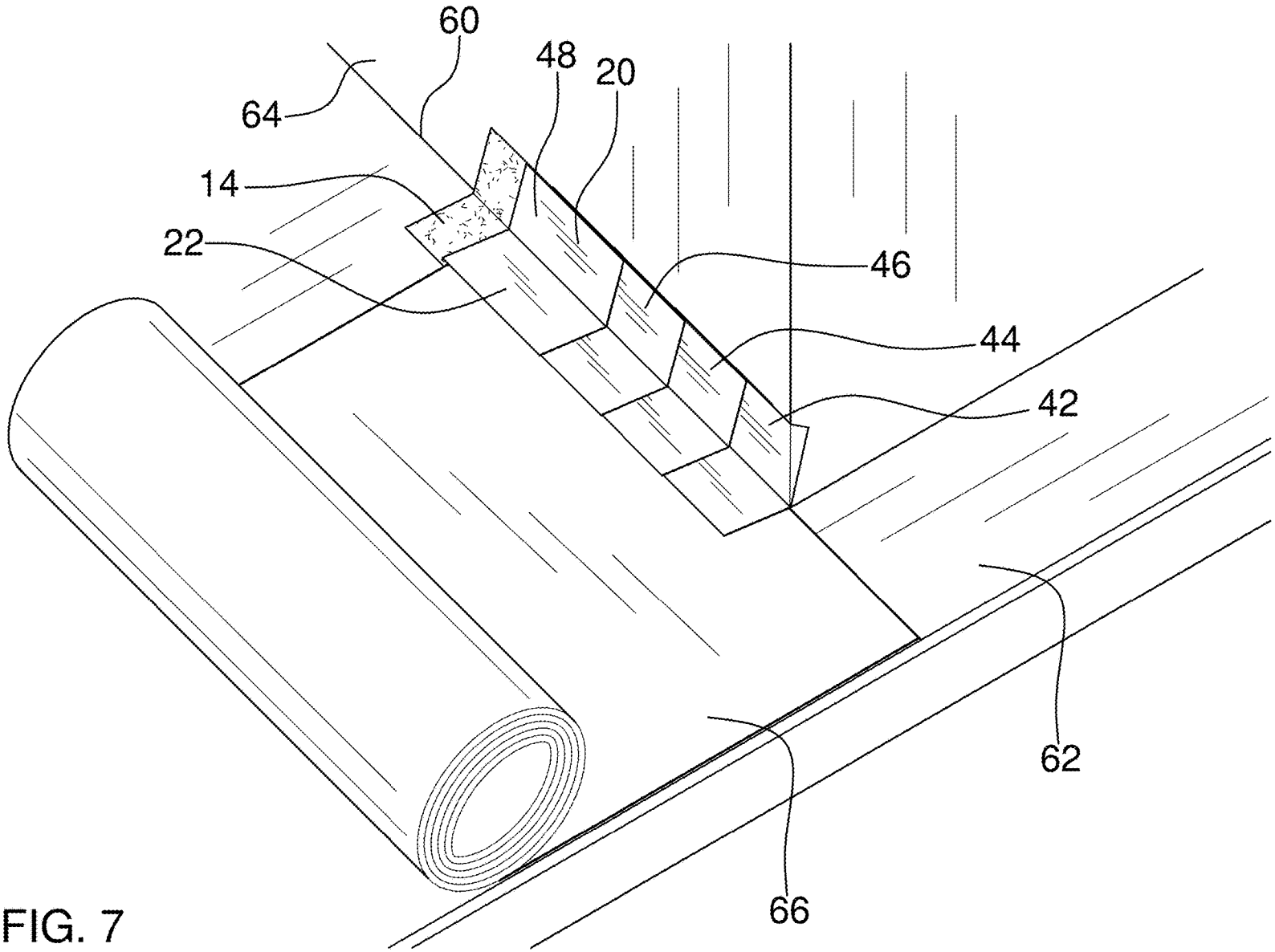
FIG. 7 is a perspective view of an embodiment of the disclosure in use.
Figure 8:
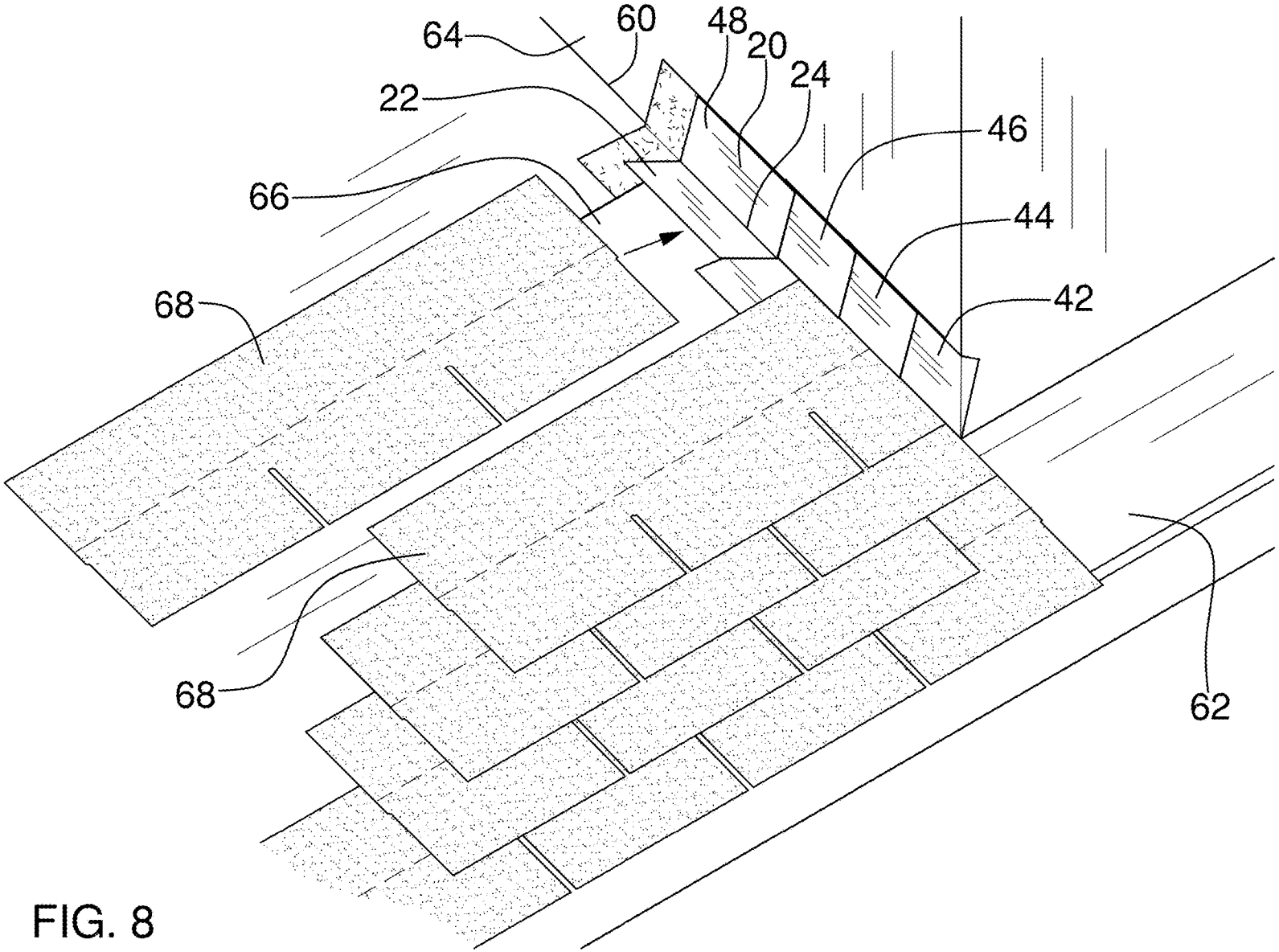
FIG. 8 is a perspective view of an embodiment of the disclosure in use.

FIGS. 7 and 8 show installment of an underlayment 66 and shingles 68. In the exemplary embodiment shown, the first panel portion 20 overlaps the sidewall 64 and the second panel portion 22 overlaps the roof deck 62. Once the underlayment 66 is ready, to install the underlayment 66, as shown in FIG. 7, the worker temporarily lifts the second panel portion 22 and inserts a portion of underlayment 66 between the second panel portion 22 and the layer 14 underneath the second panel portion 22. Once the underlayment 66 is installed, the worker can move on installment of shingles 68 as shown in FIG. 8. Again, the worker can temporarily lift the second panel portion 22 and insert a portion of a shingle 68 under the second panel portion 22.

The design of the step flashing and moisture barrier assembly 10 provides a couple installation advantages. In a traditional roof installation, the layer 14 of moisture-proof material is first installed by itself and then the underlayment 66, which is usually felt material or similar, is placed over the moisture-proof material and nailed in place. One common problem is that workers often have to cut the underlayment 66 roll, and they use the layer 14 of moisture-proof material as a guide, which results in the workers often accidentally cutting the layer 14 of moisture-proof material, thereby defeating its purpose as a barrier to water. By having the panel 12 already installed, the panel 12 can protect the layer 14 from such damage and provide the workers with a safe cutting surface. In addition, it is common to have to install moisture-proof material under counterflashing. This can be very difficult because the moisture-proof material is flexible and can become extremely pliable in the hot temperatures common to roof work. The attached panel 12 can function as a reinforcement for insertion under counterflashing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A step flashing and moisture barrier assembly comprising:

a panel having a front surface and a back surface and comprising a first panel portion and a second panel portion joined transversely at a corner extending across said panel;

a layer of moisture-proof material having a front surface attached to said back surface of said panel and a back surface comprising an adhesive material to permit attachment of the step flashing and moisture barrier assembly to a roof structure at a juncture of two roof surfaces;

wherein said panel comprises metal;

wherein each of said first panel portion and said second panel portion is about 7.0 to 9.0 inches long at said corner and about 3.5 to 4.5 inches wide;

wherein each of said first panel portion and said second panel portion is rectangular;

wherein said first panel portion is disposed at about a 90-degree angle to said second panel portion;

wherein said layer and said panel are offset with respect to one another in a direction parallel to said corner such that said layer partially overlaps said panel, wherein said layer has an uncovered front surface section and said panel has an uncovered back surface section;

wherein said layer is attached to said back surface at said corner and not attached at edges of said panel to permit insertion of a portion of underlayment and a portion of a shingle between said layer and said panel;

wherein said layer is attached at an attachment section of said back surface, said attachment section runs along a length of said corner and extends from said corner about 1.0 inch on each of said first panel portion and said second panel portion;

wherein said layer comprises a peel-off cover disposed on said adhesive;

wherein said layer is flexible and comprises at least one of: polymers, bitumen, and rubberized asphalt; and wherein said layer is about the same size as said panel.

2. The step flashing and moisture barrier assembly of claim 1, wherein said uncovered front surface section of said layer is about 2.0 to about 4.0 inches wide, and said uncovered back surface section of said panel is about 2.0 to about 4.0 inches wide.

3. The step flashing and moisture barrier assembly of claim 1, wherein said attachment section extends from said corner about 2.0 inches.

4. The step flashing and moisture barrier assembly of claim 1, wherein:

said uncovered front surface section of said layer is about 2.0 to about 4.0 inches wide, and said uncovered back surface section of said panel is about 2.0 to about 4.0 inches wide; and said attachment section extends from said corner about 2.0 inches.

5. A method of installing step flashing using a step flashing and moisture barrier assembly comprising a panel having a front surface and a back surface and comprising a first panel portion and a second panel portion joined transversely at a corner extending across said panel; and a layer of moisture-proof material having a front surface attached to said back surface of said panel and a back surface comprising an adhesive material to permit attachment of the step flashing and moisture barrier assembly to a roof structure at a juncture of two roof surfaces, said method comprising the step of attaching said adhesive material to a roof structure at a juncture of two roof surfaces with said corner aligned with said juncture;

wherein said layer and said panel are offset with respect to one another in a direction parallel to said corner such that said layer partially overlaps said panel, wherein said layer has an uncovered front surface section and said panel has an uncovered back surface section, wherein the step flashing and moisture barrier assembly comprises a first step flashing and moisture barrier assembly and a second step flashing and moisture barrier assembly, and said method further comprises:

placing said second step flashing and moisture barrier assembly in a stepped, partially overlapping manner on said first step flashing and moisture barrier assembly, such that:

said layer of said second step flashing and moisture barrier assembly abuts said layer of said first step flashing and moisture barrier assembly;

said layer of said second step flashing and moisture barrier assembly overlaps and attaches to said uncovered front surface section of said layer of said first step flashing and moisture barrier assembly; and said panel of said second step flashing and moisture barrier assembly partially overlaps said panel of said first step flashing and moisture barrier assembly.

6. A method of installing step flashing using a step flashing and moisture barrier assembly comprising a panel having a front surface and a back surface and comprising a first panel portion and a second panel portion joined transversely at a corner extending across said panel; and a layer of moisture-proof material having a front surface attached to said back surface of said panel and a back surface comprising an adhesive material to permit attachment of the step flashing and moisture barrier assembly to a roof structure at a juncture of two roof surfaces, said method comprising the step of attaching said adhesive material to a roof structure at a juncture of two roof surfaces with said corner aligned with said juncture;

wherein said layer is attached to said back surface at said corner and not attached at edges of said panel to permit insertion of a portion of underlayment and a portion of a shingle between said layer and said panel, and wherein:

said step of attaching said adhesive material to a roof structure comprises adhering said first panel portion to a sidewall and said second panel portion to a roof deck; and temporarily lifting said second panel portion and inserting an edge portion of underlayment between said second panel portion and said layer underneath said second panel portion.

* * * * *